US007195507B2

(12) United States Patent
Watanabe

(10) Patent No.: US 7,195,507 B2
(45) Date of Patent: Mar. 27, 2007

(54) SOCKET APPARATUS WITH ACTUATION VIA PIVOTAL MOTION

(75) Inventor: Hideo Watanabe, Tokyo (JP)

(73) Assignee: Yamaichi Electronics U.S.A., Inc., San Jose, CA (US)

( * ) Notice: Subject to any disclaimer, the term of this patent is extended or adjusted under 35 U.S.C. 154(b) by 47 days.

(21) Appl. No.: 10/710,850

(22) Filed: Aug. 6, 2004

(65) Prior Publication Data

US 2005/0181654 A1 Aug. 18, 2005

Related U.S. Application Data

(60) Provisional application No. 60/493,373, filed on Aug. 6, 2003.

(51) Int. Cl.
*H01R 13/62* (2006.01)

(52) U.S. Cl. ..... 439/331; 439/73; 439/263

(58) Field of Classification Search ..... 439/331, 439/135–136, 892–893, 268, 73, 263
See application file for complete search history.

(56) References Cited

U.S. PATENT DOCUMENTS

| | | | | |
|---|---|---|---|---|
| 4,808,119 | A * | 2/1989 | Pfaff | 439/268 |
| 5,470,247 | A * | 11/1995 | Fuchigami | 439/264 |
| 5,482,471 | A * | 1/1996 | Mori et al. | 439/263 |
| 5,646,447 | A * | 7/1997 | Ramsey et al. | 257/727 |
| 6,027,355 | A * | 2/2000 | Ikeya | 439/268 |
| 6,106,319 | A * | 8/2000 | Fukunaga et al. | 439/342 |
| 6,293,809 | B1 * | 9/2001 | Shimada | 439/71 |
| 6,296,505 | B1 * | 10/2001 | Fukunaga et al. | 439/268 |
| 6,471,531 | B2 * | 10/2002 | Kanesashi | 439/268 |
| 2003/0194898 | A1 * | 10/2003 | Hachuda | 439/331 |

* cited by examiner

*Primary Examiner*—Michael C. Zarroli
(74) *Attorney, Agent, or Firm*—Squire, Sanders & Dempsey, L.L.P.

(57) ABSTRACT

A socket apparatus includes a lid pivotally coupled to a socket. When the lid is in an open position, contacts in the socket are actuated to an open position for receiving an integrated circuit. When the lid is closed, levers coupled to the lid cease actuating the contacts, causing them to close and therefore contact pins of the integrated circuit for testing.

6 Claims, 11 Drawing Sheets

SOCKET APPARATUS WITH ACTUATION VIA PIVOTAL MOTION

CROSS REFERENCE TO RELATED APPLICATION

This application claims benefit and incorporates by reference, U.S. Patent Application No. 60/493,373 filed Aug. 6, 2003, entitled "Test and Burn-In Socket Apparatus with Actuation Via Pivotal Motion" by inventor Hideo Watanabe.

TECHNICAL FIELD

This invention relates generally to test and burn-in sockets, and more particularly, but not exclusively, provides a socket apparatus that actuates based on pivotal motion of a lid and a method of use thereof.

BACKGROUND

Integrated circuit (IC) devices are tested after manufacture by attaching each manufactured IC device to a printed circuit board (PCB) having testing functionality. Generally, the PCB is coupled to a socket that enables loading and unloading of the IC device from the PCB, preferably without damaging the IC device.

Conventional sockets generally include a base attached to the PCB via contacts. A spring-loaded cover closes contacts on the socket, thereby enabling an electrical connection between the PCB and the IC.

However, a disadvantage of a conventional socket is that it requires several steps to load the IC device into the socket. For example, loading an IC into a conventional socket may entail opening a cover, depressing a lever to open up pins, docking the IC into the socket, releasing the lever, and then closing the cover. An additional disadvantage of the conventional socket is that the socket design does not enable the mating of a heat sink to the socket to dissipate heat during testing.

Accordingly, a new socket and method of use are required to overcome these disadvantages.

SUMMARY

Embodiment of the present invention overcome the above-mentioned disadvantages by providing a socket apparatus with a pivotal lid that opens and closes contacts based on the lid's rotation position.

In an embodiment of the invention, the socket apparatus comprises: a socket having contacts disposed therein; and a lid pivotally coupled to the socket, wherein pivotal motion of the lid opens and closes the contacts.

In an embodiment of the invention, a method using the socket apparatus comprises: loading an IC into the socket apparatus; closing the lid of the apparatus; and testing the IC.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DETAILED DESCRIPTION OF THE ILLUSTRATED EMBODIMENTS

The following description is provided to enable any person having ordinary skill in the art to make and use the invention, and is provided in the context of a particular application and its requirements. Various modifications to the embodiments will be readily apparent to those skilled in the art, and the principles defined herein may be applied to other embodiments and applications without departing from the spirit and scope of the invention. Thus, the present invention is not intended to be limited to the embodiments shown, but is to be accorded the widest scope consistent with the principles, features and teachings disclosed herein.

Figure 1:
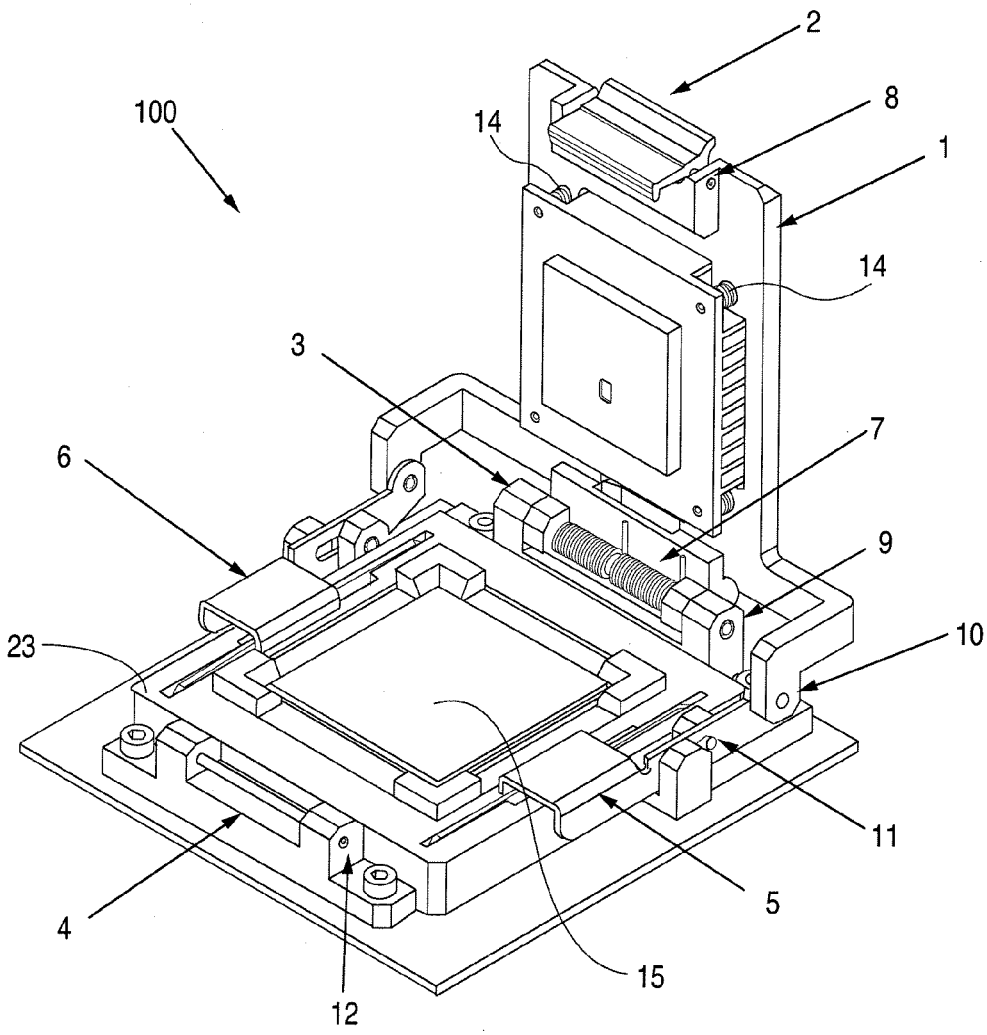
FIG. 1 is a diagram illustrating a perspective view of a socket apparatus in an open position according to an embodiment of the invention.

FIG. 1 is a diagram illustrating a perspective view of a socket apparatus 100 in an open position according to an embodiment of the invention. The socket apparatus comprises a socket 23 mounted to a board 19. The socket 23 is in turn mounted to a lid 1 via a hinge block 3 that enables the lid 1 to pivot relative to the socket 23. The hinge block 3 includes a coil spring 7 that, in an embodiment of the invention, is biased outwards such that the lid 1 is biased to an open position. The lid 1 includes a latch 2 that latches to a shaft 12 of a latch block 4 (on the opposite side of the socket 23 from the hinge block 4) of the socket 23 when the lid 1 is in a close position so as to lock the lid 1 to the socket 23 during IC testing. The lid 1 further includes a heat sink 16 that absorbs heat from an IC 15 mounted on the socket 23 during testing and then dissipates the absorbed heat.

The lid frame 1 is coupled to actuation arms 5 and/or 6 on the socket 23, which are in turn coupled to levers 13. The levers 13 are coupled to contacts 22 via a shuttle plate 20. When the lid 1 is in an open position, the contacts 22 are in an open position for receiving the IC 15. Pivoting the lid frame 1 to a closed positioned causes the actuations arms 5 and/or 6 to cease actuating the levers 13, thereby enabling the closing of the contacts 22 so that they can electrically connect with the IC 15.

Figure 2:
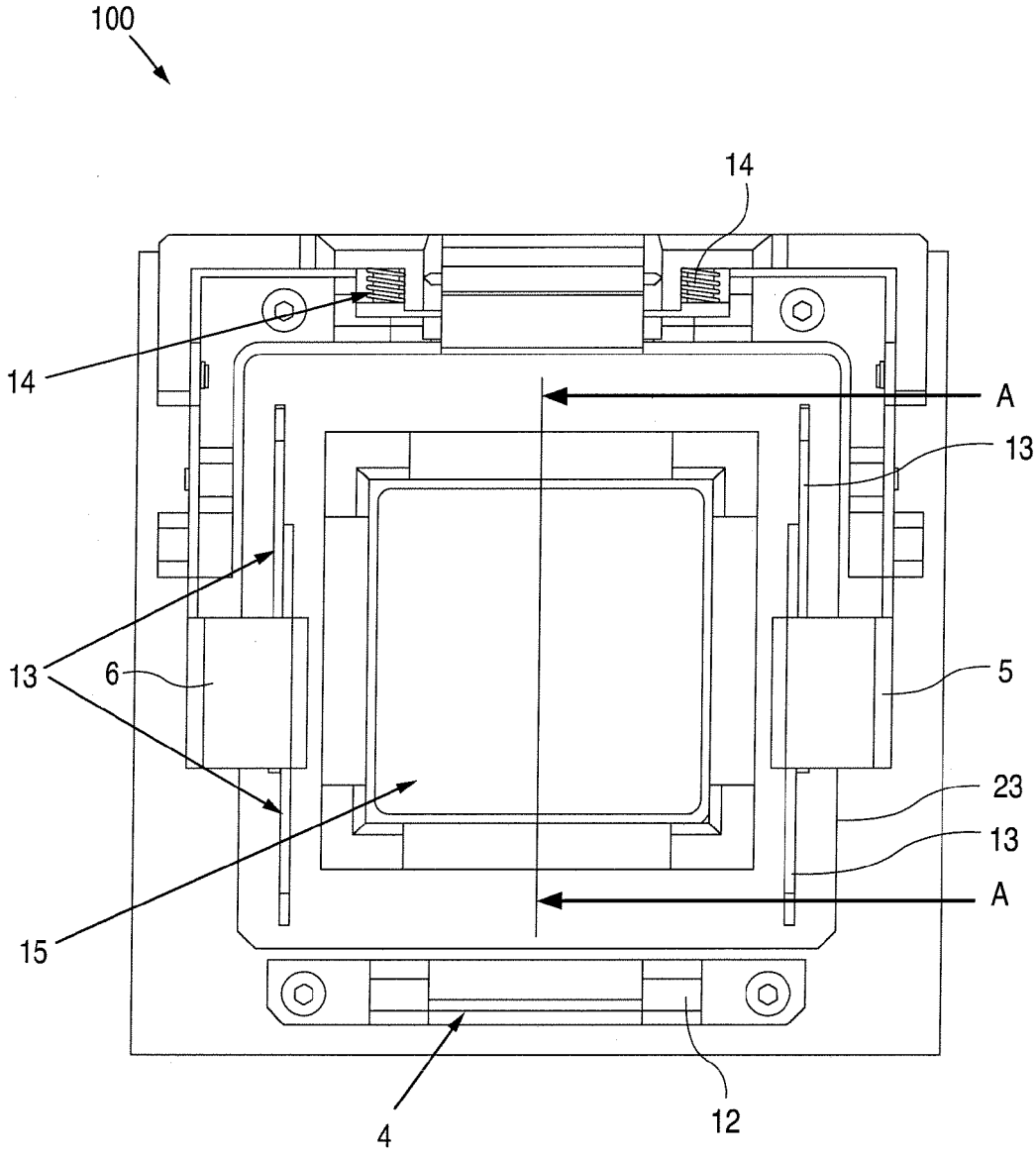
FIG. 2 is a diagram illustrating a top view of the socket apparatus.

FIG. 2 is a diagram illustrating a top view of the socket apparatus 100. When the lid 1 is in a open position, the actuation arms 5 and/or 6, which are coupled to the levers 13, cause the levers 13 to keep the contacts 22 in an open position to receive the IC 15. Closing the lid 1 causes the actuation arms 5 and/or 6 to cease actuating the levers 13, causing the contacts 22 to close, thereby contacting the IC 15 for testing.

In an embodiment of the invention, the heat sink 16 is coupled to the lid 1 via one or screws 17 (FIG. 4) with coil springs 14 interspersed between the heat sink 16 and the lid 1 (circumscribing the screws 17). The springs 14, which cause the heat sink 16 to be biased downwards, also enable the heat sink 16 to move upwards when the lid 1 is closed and when the heat sink 16 is pressed against the IC 15, i.e., the IC 15 pushes against the heat sink 16 when the lid 1 is closed, thereby pushing the heat sink 16 upwards.

Figure 3:
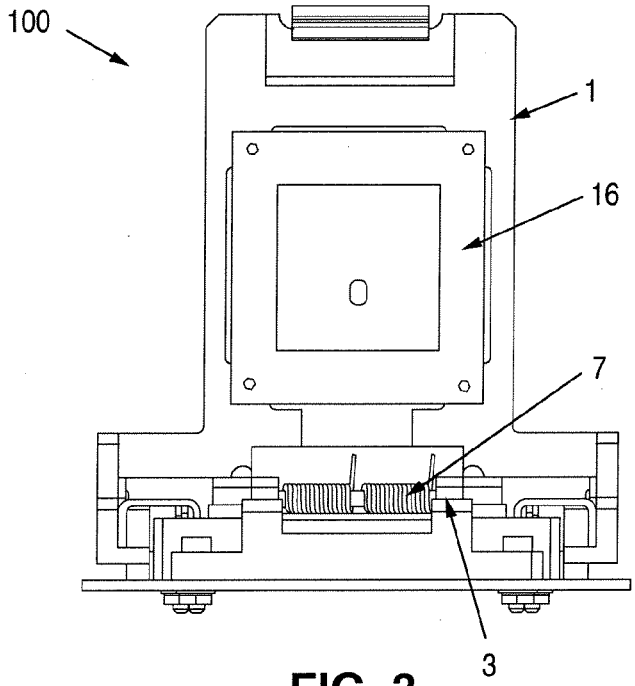
FIG. 3 is a diagram illustrating a front view of the socket apparatus in an open position.

FIG. 3 is a diagram illustrating a front view of the socket apparatus 100 in an open position. The coil springs 7 are mounted on the hinge block 3, which pivotally couples the socket 23 to the lid 1. The coil spring 7 is biased outwards so that the lid 1 is biased towards an open position.

Figure 4:
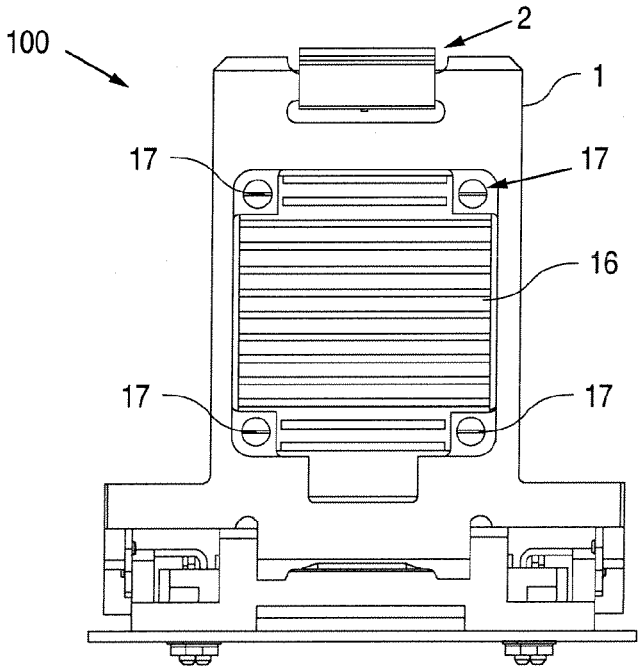
FIG. 4 is a diagram illustrating a back view of the socket apparatus in an open position.

FIG. 4 is a diagram illustrating a back view of the socket apparatus 100 in an open position. In an embodiment, four screws 17 couple the heat sink 16 to the lid 1.

Figure 5:
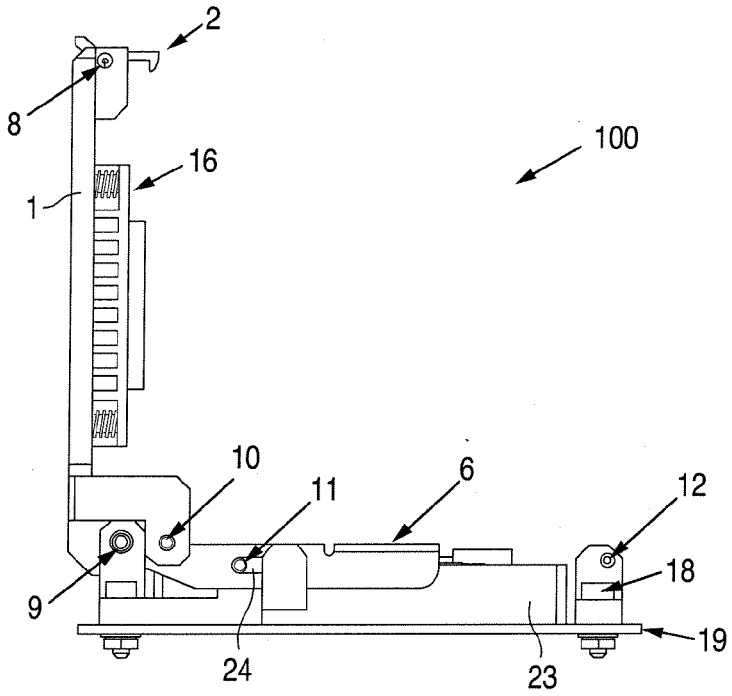
FIG. 5 and FIG. 6 are diagrams illustrating side views of the socket apparatus in an open position.
Figure 6:
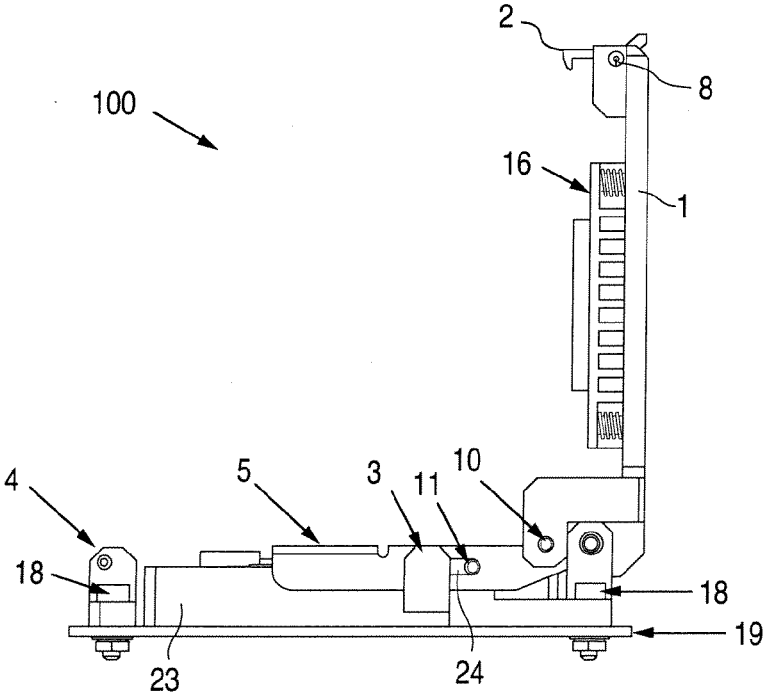
Figure 7:
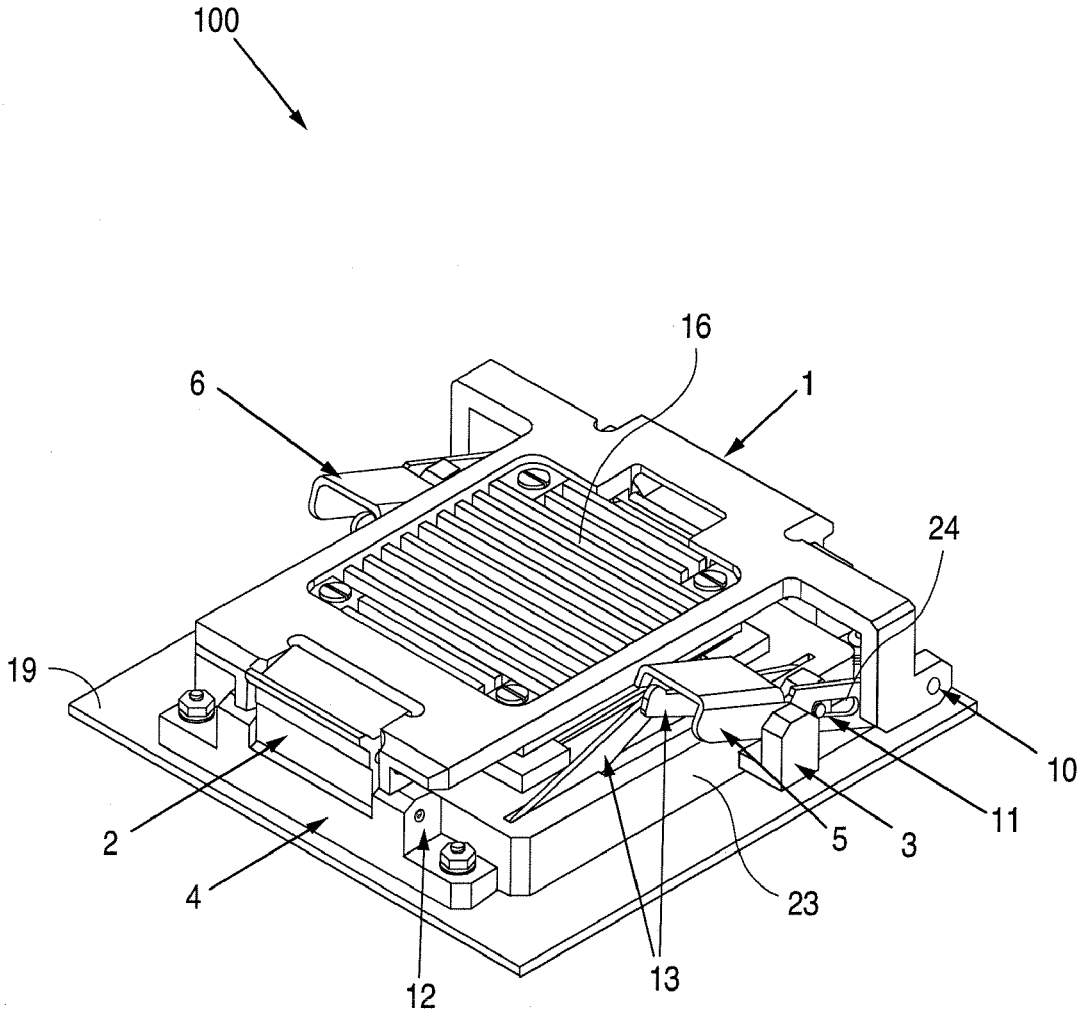
FIG. 7 is a diagram illustrating a perspective view of the socket apparatus in a closed position.
Figure 8:
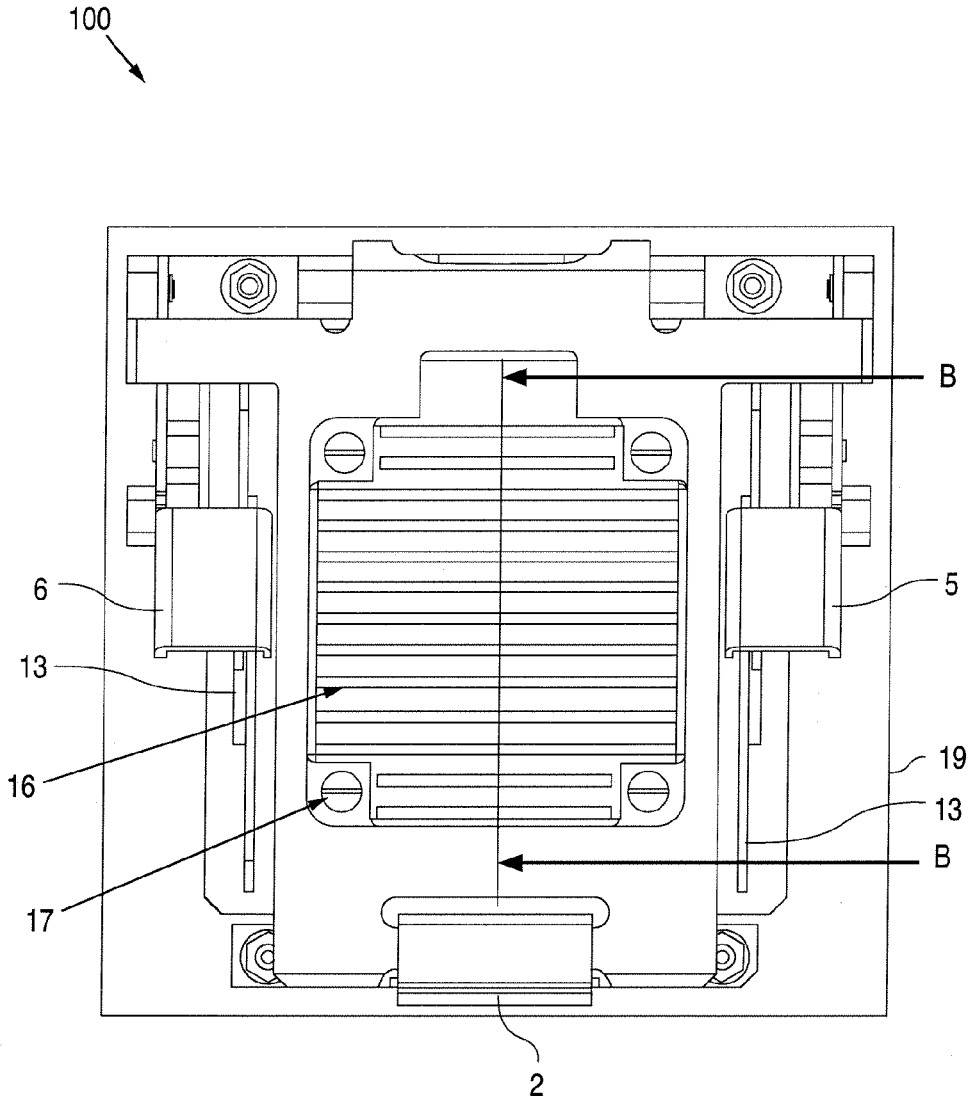
FIG. 8 is a diagram illustrating top view of the socket apparatus in a closed position.
Figure 9:
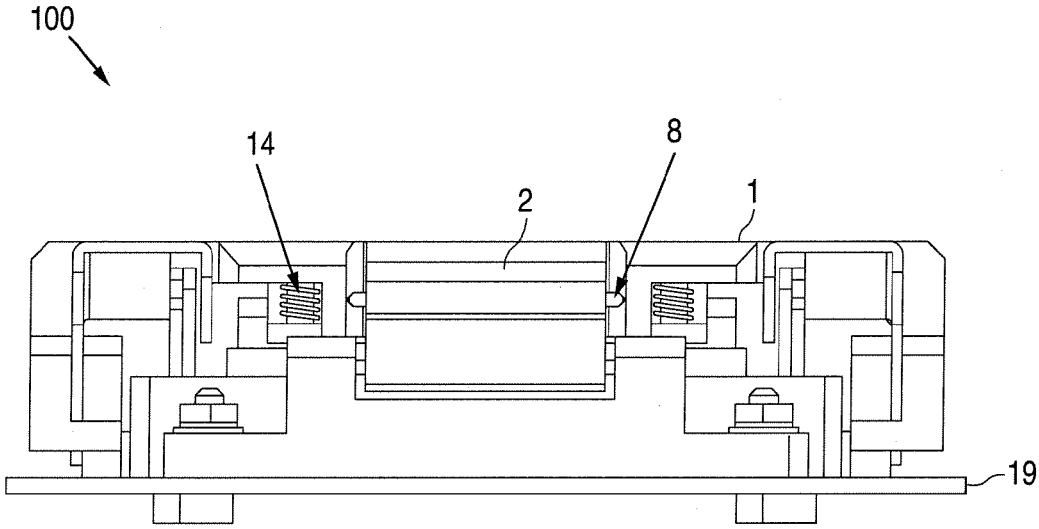
FIG. 9 is a diagram illustrating a front view of the socket apparatus in a closed position.
Figure 10:
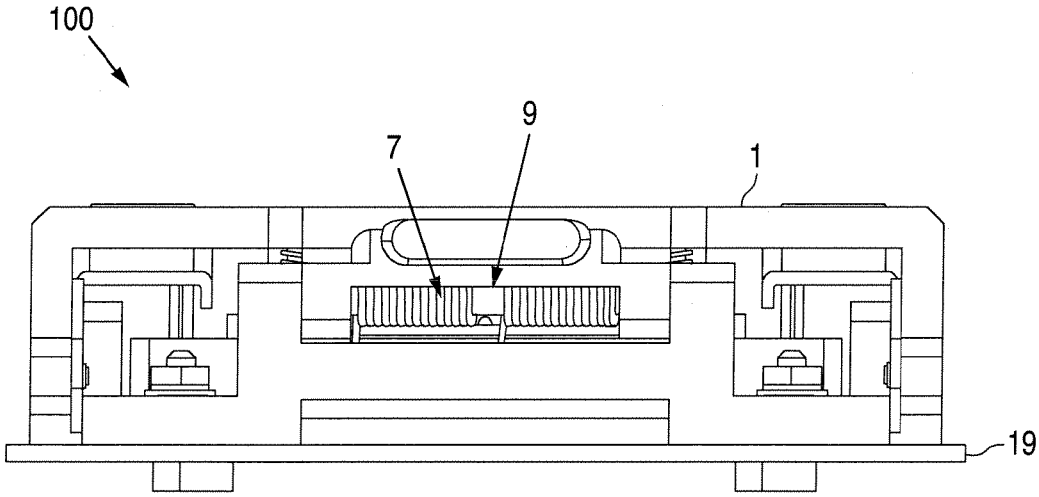
FIG. 10 is a diagram illustrating a back view of the socket apparatus in a closed position.
Figure 11:
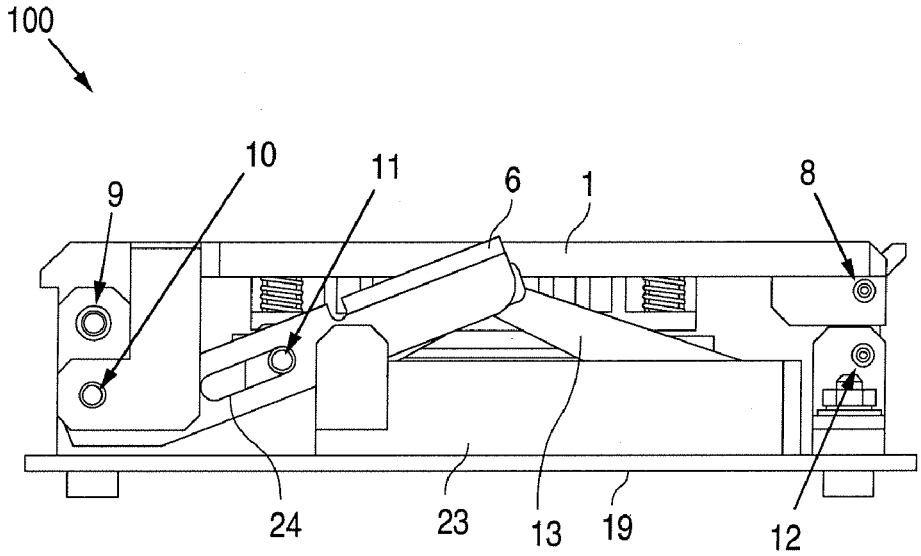
FIG. 11 and FIG. 12 are diagrams illustrating side views of the socket apparatus in a closed position.
Figure 12:
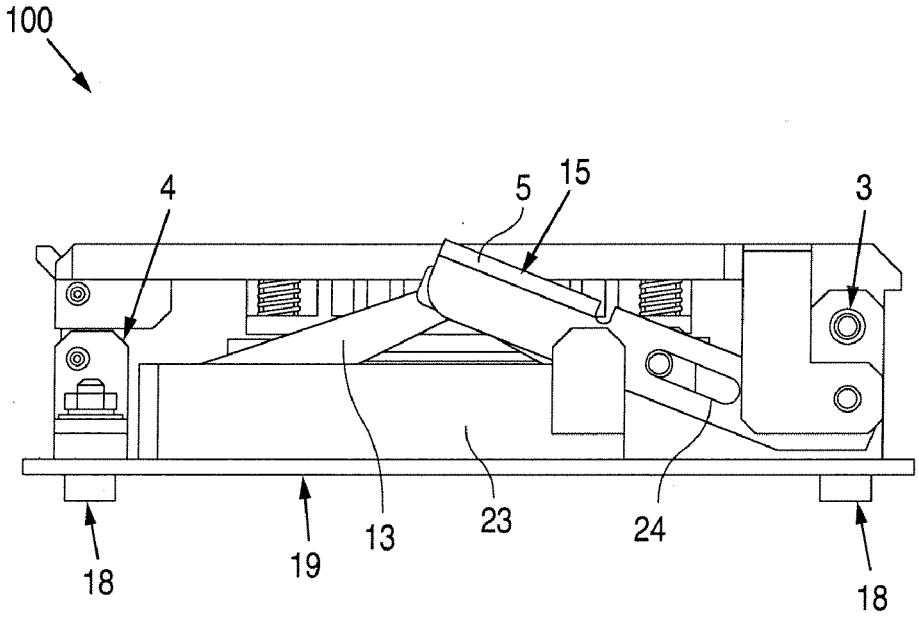

FIG. 5 and FIG. 6 are diagrams illustrating side views of the socket apparatus 100 in an open position. A latch 2 is coupled to the lid 1 via a shaft 8, thereby enabling the latch 2 to rotate. Coupled between the latch 2 and the lid 1 is a coil spring (not shown) that biases the latch 2 to a closed (or locked) position. Accordingly, when the lid 1 is closed by latching the latch 2 to a shaft 12 of the latch block 4, the spring will bias the latch 2 in a locked position, thereby locking the socket apparatus 100.

The lid 1 is coupled to the socket 23 via the hinge block 3, which comprises a shaft 9. The lid 1 is coupled to the actuation arms 5 and 6 via shafts 10. A shaft 11 is coupled to the socket 23 and is stationary. The shafts 11 are positioned within a guide slot 24 of the arms 5 and 6 so as to limit (control) the motion of the actuation arms 5 and 6. The arms 5 and 6 slide along the stationary shaft 11 during movement of the lid 1, which actuates (open position) and releases (closed position) the levers 13. The guide slots 24 limit/confine the sliding of the arms 5 and 6. The socket 23 is indirectly mounted to the board 19 via mounting hardware 18 that couples the hinge block 3 and the latch block 4 to the board 19.

FIG. 7–FIG. 12 are drawings illustrating perspective, top, front, rear, and side views, respectively, of the socket apparatus 100 in a closed position. When the lid 1 is closed, the latch 2 latches onto the shaft 8 of the latch block 4, thereby biasing the socket apparatus 100 to closed position. Further, as will be discussed in further detail in conjunction with FIG. 13 below, closing the lid 1 causes the levers 13 to close the contacts 22, thereby enabling electrical contact between the IC 15 and the socket 23.

Figure 13:
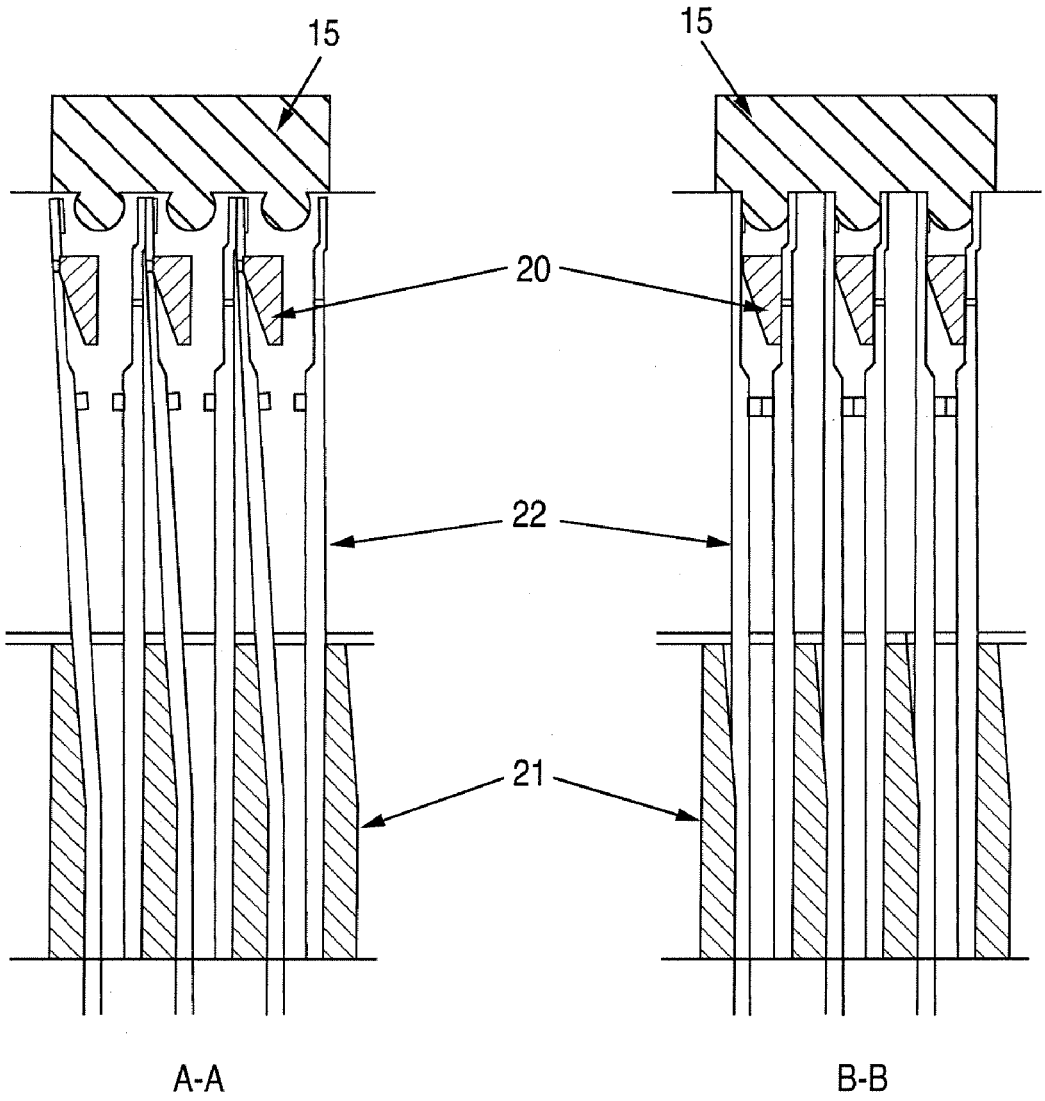
FIG. 13 are diagrams illustrating cross sections of the contacts of the socket.

FIG. 13 are diagrams illustrating cross sections of the contacts 22 of the socket 23. The levers 13 are coupled to a shuttle plate 20, which is interspersed between the contacts 22. When the lid 1 is open, as shown in cross-section A—A of FIG. 13, the shuttle plate 20 holds open the contacts 22 so that they do not contact the pins of the IC 15 and to enable mounting of the IC 15 into the socket 23. Once the lid 1 is closed, as shown in cross-section B—B, the levers 13 cease activating the shuttle plate 20, causing the contacts 22 to close, thereby contacting the pins of the IC 15.

Figure 14:
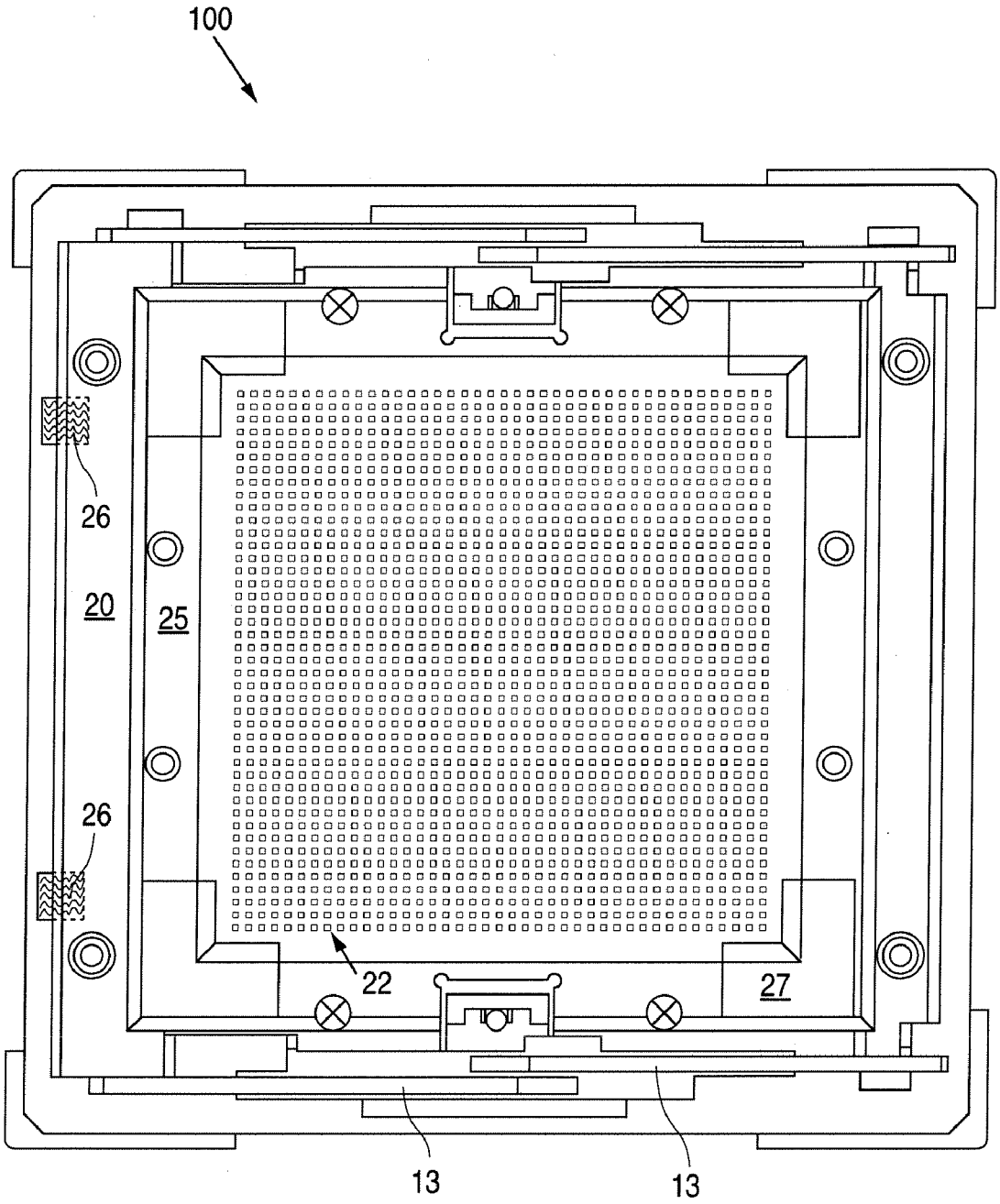
FIG. 14 is a diagram illustrating a cross section of the socket apparatus.
Figure 15:
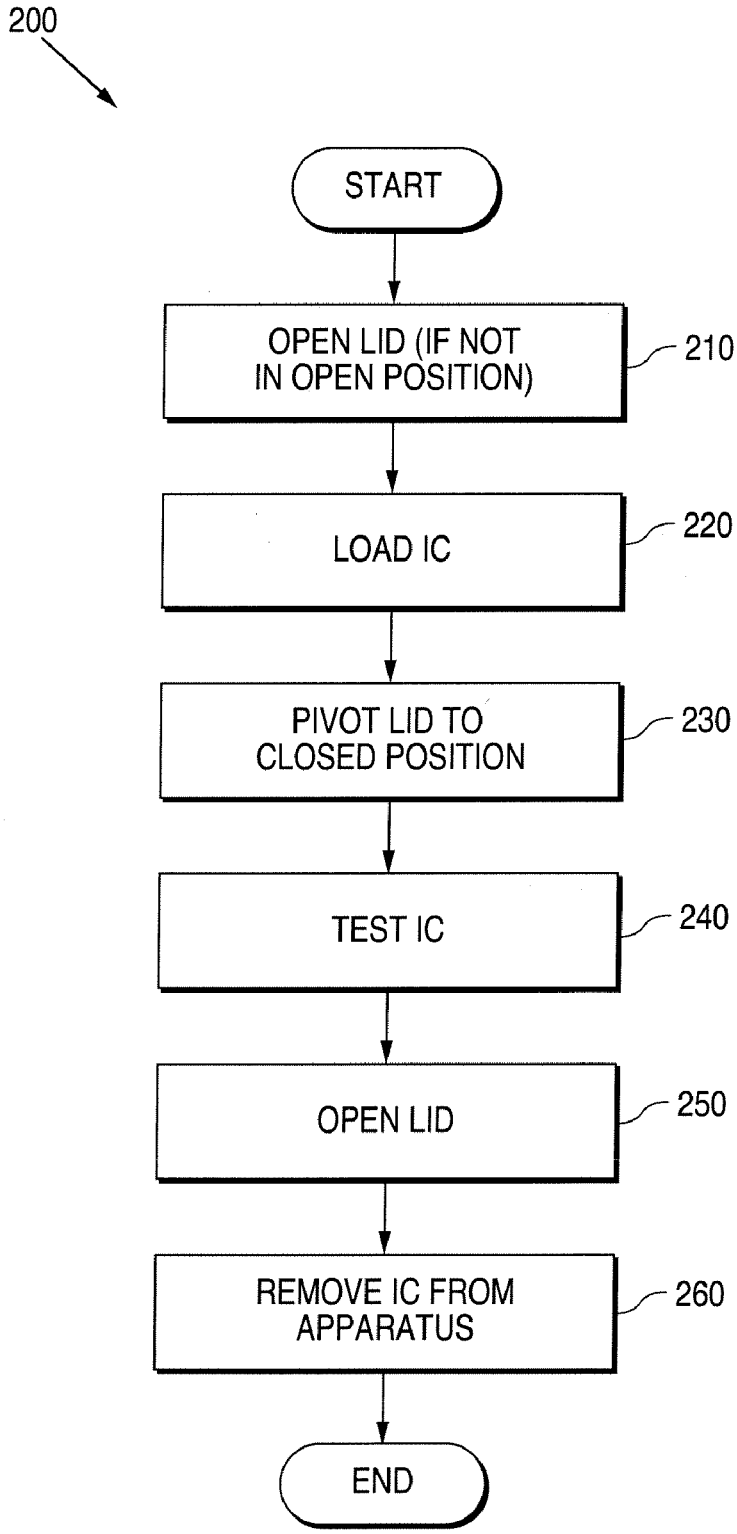
FIG. 15 is a flowchart illustrating a method of using the socket apparatus.

FIG. 14 is a diagram illustrating a cross section of the socket apparatus 100. The socket apparatus 100 has a generally rectangular stiffening frame 25 coupled to the shuttle plate 20, The stiffening frame 25 has a plurality of corners, with at least one of the corners having a generally L-shaped lead-in guide 27 for helping guide alignment of an integrated circuit 15 with the shuttle plate 20 as the integrated circuit 15 is being received by shuttle plate 20.

In an embodiment of the invention, the board 19 has a generally rectangular outer perimeter and substantially planar upper and lower faces. The outer perimeter of board 19 has a plurality of rounded corners for helping to prevent the catching of objects on the corners of the board 19. The board 19 may also have a plurality of mounting hardware downwardly extending from the lower face of the board 19 for permitting mounting of the board 19 to an object to hold the board 19 in a fixed position with respect to the object. The mounting fasteners of the board 19 may comprise threaded fasters and be spaced apart and each mounting fastener may be positioned towards an associated corner of the board.

The socket 23 is coupled to the upper face of the board 19 and has a generally rectangular outer perimeter, a front, a rear, and a pair of sides extending between the front and back of the socket, the front and rear of the socket 23 are substantially parallel with each other. The sides of the socket 23 are substantially parallel with each other and substantially perpendicular with the front and rear of the socket 23.

The socket 23 may comprise an outer base insulator and an inner shuttle plate 20 disposed in a generally rectangular space defined by the base insulator of the socket 23.

The shuttle plate 20 is movable in the space defined by the base insulator of the socket 23 between a forwards position and a rearwards position. The shuttle plate 20 is positioned closer towards the front of the socket 23 when in the forwards position than when in the rearwards position. The shuttle plate 20 is positioned closer towards the rear of the socket when in the rearwards position than when in the forwards position.

The shuttle plate 20 is biased in a direction towards the forwards position. The socket 23 has one or more springs 26 for biasing the shuttle plate 20 towards the forwards position. The one or more springs 26 of the socket each include a coiled compression spring and are interposed between the base insulator and the shuttle plate 20 of the socket 23 and located towards the rear of the socket 23.

The lid 1 has a front, a back, a pair of sides, a top face, a bottom face and a cutout, the cutout extending through the top and bottom faces of the lid 1 and having a generally rectangular periphery. The cutout of the lid 1 has a generally rectangular space outwardly extending from the periphery of the cutout located towards the back of the lid 1.

The lid 1 has a pair of arms 5 and 6 outwardly extending in opposite directions from the lid 1; each arm 5,6 of the lid 1 extend from an associated side of the lid 1 and are positioned towards the back of the lid frame;

The heat sink 16 comprises a plate with a generally rectangular outer perimeter, a lower block extending from a lower face of the plate of the heat sink 16, and a plurality of cooling fins extending from an upper face of the plate. The lower block of the heat sink 16 has a generally rectangular configuration and is thermally coupled to at least portion of the cooling fins to permit transfer of heat from the lower block of the heat sink 16 to the cooling fins, which are substantially evenly spaced apart and lying in substantially parallel planes with one another that are substantially perpendicular to a plane in which the plate of the heat sink 16 lies.

The plate of the heat sink 16 is coupled to the lid 1 by a plurality of screws 17 so that at least a portion of the cooling fins extend into the cutout of the lid frame. Each screw 17 extends through a corner tab located adjacent an associated corner of the cutout of the lid 1 and is coupled to a corresponding corner of the plate of the heat sink 16. The plate of the heat sink 16 is biased in a downward direction away from the lid 1 and towards the socket 23 when the lid is in the closed position by a plurality of coiled springs disposed around the screws 17.

The heat sink 16 is positioned over the shuttle plate 20 of the socket 23 when the lid 1 is in the closed position and the lower block of the heat sink 16 is adapted for contacting an upper portion of an integrated circuit received by the socket 23.

The hinge block 3 is coupled to the upper face of the board and positioned adjacent the rear of the socket 23. The hinge block 3 has a spaced apart pair of lower arms positioned adjacent the upper face of the board, each of the lower arms of the hinge block having a corresponding one of the mounting fasteners of the board extending therethrough to couple the hinge block 3 to the board 19.

The hinge block has a pivot shaft 9 extending between a pair of upper arms and is located above a plane defined by a top face of the socket 23, the back of the lid 1 being pivotally mounted to the pivot shaft 9 of the hinge block 3 to permit pivoting of the lid 1 between the open and closed positions. The hinge block 3 has at least one spring disposed around the pivot shaft and having an end abutting the bottom face of the lid 1 to bias the lid towards the open position.

The latch block 4 is coupled to the upper face of the board 19 and positioned adjacent the front of the socket 23. The latch block 4 has a pair of oppositely extending sides, each side of the latch block 4 having a corresponding one of the mounting fasteners (e.g., mounting hardware 18) of the board 19 extending therethrough to couple the latch block 4 to the board 19.

The latch block 4 has a shaft 8 extending between a spaced apart pair of upwardly extending arms. The latch 2 is pivotally coupled to the front end of the lid 1 and is adapted for releasably engaging the shaft 8 of the latch block 4 when the lid 1 is positioned in the closed position. The latching is biased by a spring interposed between the latch 2 and the lid 1 in a direction that urges the latch 2 in a first direction that holds the latch 2 in a latching position against the shaft 8 of the latch block 4 when the lid 1 is in the closed position. The latch 2 has a forwardly extending finger tab for engaging a finger to assist in the pivoting of the latch 2 in a second direction opposite the first direction.

The shuttle plate 20 of the socket 23 has a generally rectangular shaped configuration and with opposite top and bottom faces. The bottom face of the shuttle plate 20 faces towards the upper face of the board 19 and the top face of the shuttle plate 20 faces upwardly away from the upper face of the board.

The top face of the shuttle plate 20 is adapted for receiving an integrated circuit and having a plurality of apertures adapted for receiving connecting pins of the integrated circuit 15. The socket further comprises a cover screen on the top face of the shuttle plate 20 and has a plurality of holes therethrough, each hold of the cover screen being in a substantially common alignment with the apertures of the shuttle plate 20.

The socket 23 has a plurality of elongate contacts 22 upwardly extending through at least a portion of the apertures of the shuttle plate 20. Each aperture of the at least a portion of the apertures of the shuttle plate 20 has at least a plurality of contacts extending therein, at least one of the plurality of contacts 22 being spaced apart from at least one other of the plurality of contacts 22 in each aperture when the shuttle plate 20 is in the forwards position.

Moving the shuttle plate 20 in a direction from the forwards position towards the rearwards direction causes side walls of the apertures having contacts 22 extending therein to force one of the contacts 22 in each respective aperture towards at least one of the other contacts in the respective aperture to permit insertion of at least one contact pin of the integrated circuit 15 between the contacts of adjacent apertures. Each contact in an aperture of the shuttle plate has at least one associated contact 22 in an adjacent aperture of the shuttle plate 20 defining an associated pair of contacts 22. The contacts 22 of each associated pair of contacts 22 each has an extent that are in electrical contact with one another when the shuttle plate 20 in is the forward position and spaced apart from one another when the shuttle plate 20 is in the rearwards position.

A pair of latch assemblies move the shuttle plate 20 from the forwards position towards the rearwards position when the lid 1 is pivoted from the closed position towards the open position. Each latch assembly is positioned towards associated sides of the socket 23 and the lid 1.

The latch assemblies include a pair of levers 13 comprising a front lever and a back lever. Each lever 13 each has opposite upper and lower ends, the lower end of the front lever being positioned towards the front of the socket 23 and extending between the base insulator and shuttle plate 19 of the socket 23. The lower end of the back lever being positioned towards the rear of the socket 23 and extending between the base insulator and shuttle plate 20 of the socket 23.

The latch assemblies further include a front and back pairs of stops located between the base insulator and the shuttle plate 20 with each pair of stops having a first stop coupled to the base insulator and a second stop coupled to the shuttle plate and spaced apart from the first stop.

Each lever 13 has a cam extending from the lower end of the respective lever. The cam of the front lever is interposed between the stops of the front pair of stops and the cam of the back lever being interposed between the stops of the back pair of stops. The stops in a pair of stops being moved further away from one another when the shuttle plate 20 is moved from the forwards position towards the rearwards position and being moved closer together from one another when the shuttle plate 20 is moved from the rearwards position towards the forwards position.

The levers 13 are positionable between a raised position and a lowered position. The cams of the levers 13 are rotated between the respective associated pair of stops as the levers 13 are moved between the raised and lowered positions. Moving the levers 13 from the raised position towards the lowered position causes the cams to be rotated in a first direction and thereby force the stops of each pair of stops away from one another and move the shuttle plate towards the rearwards position. Moving the levers 13 from the lowered position towards the raised position causes the cams to be rotated in a second direction opposite the first direction and thereby force the stops of each pair of stops towards one another and move the shuttle plate towards the forwards position.

The upper ends of the levers 13 are raised away from the socket 23 when the levers 13 are moved towards the raised position. The upper ends of the levers 13 are lowered towards the socket 23 when the levers are moved towards the lowered position.

The latch assemblies further include an actuator arm 5 and/or 6 having front and back ends, the front end of the actuator arm 5/6 having a flange positioned above the upper ends of the lever 13.

The latch assemblies further include a moving pivot arm (e.g., one of levers 13) outwardly extending from a side of the lid 1 and located towards the back of the lid 1 and is pivotally coupled to the back end of the actuator arm 5/6 to permit moving of the actuator arm 5/6 when the lid 1 is moved between the open and closed position.

The latch assemblies further include a fixed pivot arm (e.g. one of levers 13) extending from the hinge block 3 along a side of the socket 23 and towards the front of the socket 23. The fixed pivot arm has a shaft 11 extending through a guide slot 24 in the actuator arm 5/6. The guide slot 24 has a longitudinal axis extending between the front and back ends of the actuator arm 5/6 and the shaft 11 of the fixed pivot arm is moved in the guide slot 24 towards a back edge of the guide slot 24 of the actuator arm 5/6 when the lid 1 is moved towards the open position. The shaft 11 of the fixed pivot arm is moved in the guide slot towards a front edge of the guide slot of the actuator arm 5/6 when the lid 1 is moved towards the closed position;

The shaft 11 of the fixed pivot arm forces the flange of the front end of the actuator arm 5/6 in a downwards direction as the back end of the actuator arm 5/6 is pivoted in a first direction when the lid 1 is moved from the closed position towards the open position so that the flange of the front end of the actuator arm 5/6 forces the upper ends of the levers 13 downwards as the lid 1 is moved towards the open position thereby rotating the cams to spread apart the stops of each pair of stops apart and move the shuttle plate 20 from the forwards position towards the rearwards position to whereby the shuttle plate 20 is moved from the forwards position towards the rearwards position as the lid is moved from the closed position towards the open position.

The upper ends of the levers 13 have rounded portions for helping to reducing frictional resistance between the flange of the actuator arm 5/6 and the upper ends of the levers 13 when the flange of the actuator arm 5/6 is forced against the upper ends of the levers 13 when the actuator arm 5/6 is pivoted as the lid 1 is moved from the closed position towards the open position.

FIG. 14 is a flowchart illustrating a method 200 of using the socket apparatus. The method 200 comprises placing (210) the apparatus 100 in an open position; loading (220) an IC 15 into the apparatus 100; pivoting (230) the lid 1 to close it, thereby closing the contacts 22; and then testing (240) the loaded IC 15. After testing, the lid 1 is pivoted to open it (250), thereby opening the contacts 22; and the IC 15 is removed (260) from the socket apparatus 100. The method 200 then ends.

Accordingly, embodiments of the invention enable loading and testing of an IC through a single actuation action, such as in the case of an open top socket. However, in contrast to open top sockets, the embodiment described above enable the coupling of a heat sink to the apparatus.

The foregoing description of the illustrated embodiments of the present invention is by way of example only, and other variations and modifications of the above-described embodiments and methods are possible in light of the foregoing teaching. The embodiments described herein are not intended to be exhaustive or limiting. The present invention is limited only by the following claims.

The invention claimed is:

1. A socket apparatus, comprising:

a socket having contacts disposed therein;

a lid pivotally coupled to the socket, wherein pivotal motion of the lid opens and closes the contacts;

an actuation arm pivotably coupled to the lid; and a shaft, wherein the pivotal motion of the lid causes the actuation arm to move to open and close the contacts in the socket, and wherein the movement of the actuation arm is controlled by the shaft.

2. The apparatus of claim 1, wherein the actuation arm actuates a lever that opens and closes the contacts in the socket.

3. The apparatus of claim 1, wherein the actuation arm has a guide slot, in which the shaft is positioned to control the movement of the actuation arm.

4. The apparatus of claim 1, further comprising a second actuation arm pivotably coupled to the lid;

a second shaft, wherein the pivotal motion of the lid causes the second actuation arm to move to open and close the contacts in the socket, and wherein the movement of the second actuation arm is controlled by the second shaft.

5. The apparatus of claim 4, wherein the second arm actuates a second lever that opens and closes the contacts in the socket.

6. The apparatus of claim 4, wherein the second actuation arm has a guide slot, in which the second shaft is positioned to control the movement of the second actuation arm.

* * * * *